US006341517B2

(12) United States Patent
Benes et al.

(10) Patent No.: US 6,341,517 B2
(45) Date of Patent: Jan. 29, 2002

(54) WIRE BENDING APPARATUS

(75) Inventors: David J. Benes, Fremont; Delmar D. Kosch, Columbus; Vincent C. Kieffer, Osceola, all of NE (US)

(73) Assignee: Waitt/Fremont Machine L.L.C., Fremont, NE (US)

( * ) Notice: Subject to any disclaimer, the term of this patent is extended or adjusted under 35 U.S.C. 154(b) by 0 days.

(21) Appl. No.: 09/766,769

(22) Filed: Jan. 22, 2001

Related U.S. Application Data

(63) Continuation of application No. 09/443,277, filed on Nov. 18, 1999, now Pat. No. 6,230,535.

(51) Int. Cl.[7] ..... B21D 7/024
(52) U.S. Cl. ..... 72/306; 72/424
(58) Field of Search ..... 72/306, 217, 388, 72/321, 216, 215, 424, 149, 156

(56) References Cited

U.S. PATENT DOCUMENTS

| | | | | |
|---|---|---|---|---|
| 4,662,204 | A | 5/1987 | Saegusa | 72/306 |
| 5,113,683 | A | 5/1992 | Lafrasse | 72/306 |
| 5,182,932 | A | 2/1993 | Ritter | 72/306 |
| 5,291,771 | A | 3/1994 | Tomo | 72/306 |

FOREIGN PATENT DOCUMENTS

| | | | |
|---|---|---|---|
| DE | 3620151 | 2/1987 | 72/306 |
| DE | 3935545 | 3/1991 | 72/306 |
| GB | 2230215 | 10/1990 | 72/306 |
| JP | 130731 | 6/1987 | 72/306 |
| JP | 224428 | * 10/1987 | 72/306 |
| SU | 797819 | * 1/1981 | 72/217 |
| SU | 1269879 | * 11/1986 | 72/306 |
| SU | 1680407 | * 9/1991 | 72/306 |

* cited by examiner

*Primary Examiner*—Daniel C. Crane
(74) *Attorney, Agent, or Firm*—Zarley, McKee, Thomte, Voorhees & Sease

(57) ABSTRACT

A wire bending device includes an upright frame and a wire feed hopper for dispensing wire rods. A wire bending section is mounted on the frame, and at least one transport arm is pivotally mounted on the frame, the transport arm operative to transport wire rods from the hopper to the wire bending section. The wire bending section includes a wire securement device mounted on the frame, the rotatable wire securement device operative to secure one end of a wire rod and rotate the wire rod about its longitudinal central axis and a wire bending unit movably mounted on the frame. The wire bending unit includes a wire bend head aligned with the center longitudinal axis of the rotatable wire securement device, the wire bending unit adapted to move on the frame such that the wire bend head remains aligned with the center longitudinal axis of the rotatable wire securement device. A control unit such as a programmable computer is operatively connected to the transport arm, the rotatable wire securement device and the wire bending unit to engage the transport arm to transport a wire rod from the hopper to the wire bending section, engage the rotatable wire securement device to secure one end of the wire rod, move the wire bend head to determined bend locations on the wire rod, rotate the wire rod about its longitudinal central axis to programmed positions, and engage the wire bend head to perform the programmed bend in the wire rod.

5 Claims, 12 Drawing Sheets

WIRE BENDING APPARATUS

CROSS-REFERENCE TO RELATED APPLICATION

This is a continuation application of Petitioners' earlier application Ser. No. 09/443,277 filed Nov. 18, 1999, entitled WIRE BENDING APPARATUS now U.S. Pat. No. 6,230,535.

BACKGROUND OF THE INVENTION

1. Technical Field

The present invention relates to wire bending mechanisms and, more particularly, to a unidirectional wire bending apparatus which includes an air bladder wire securement mechanism which secures a wire to be bent in a bending position, a computer-controlled movably mounted bending unit having a bending head travelling adjacent the wire for bending thereof, and a wire rotation mechanism for rotating the wire so that as the bending unit travels along the wire, the wire may be rotated to permit the formation of three-dimensional bends in the wire.

2. Description of the Prior Art

Various types of wire bending devices are found in the prior art, and as the field of uses for bent wires has expanded, the methods by which the various wire bending devices perform their bending processes have become ever more sophisticated and specialized. Wires are commonly used in many different applications, such as car seats and the like, and for each different seat type, a different bent wire is required to fit within the seat. Therefore, the various wire bending units in the prior art need to accommodate different bend patterns.

Some of the prior art devices include Nihashi U.S. Pat. No. 4,471,819 which discloses an apparatus for making a formed wire which bends wire by holding it at its mid-point by a holder and then consecutively bending the wire by a pair of movable bending units which start at opposite ends of the wire and move towards the center. As the bending units move along the wire, the wire is bent to a desired angle. After a bend is performed, the wire is released by the center clamp and held by clamps on each bending unit. The wire is then rotated to its new position, the center clamp reengages, and the bending units move to the next bending location. Nihashi includes several inherent disadvantages, however, such as the need for additional clamps and for the separate rotational devices which slow the bending process. Furthermore, Nihashi is a large machine, which will take up valuable shop floor space. There is therefore a need for a wire bending device that remedies these deficiencies.

Other prior art devices disclose wire bending devices that are generally inefficient, requiring either manual insertion of wires to be bent or bending devices which only permit two-dimensional bending. There is therefore a need for a wire bending device which is capable of feeding wires automatically into the bending section of the device and which includes a wire rotating device to permit the formation of three-dimensional bends in the wire.

One common type of wire bending device includes a wire feed which moves the wire past the bending head during the bending process. A major problem encountered in the operation of these devices is that the error tolerances for wire bends are often smaller than the error margins of the machine, which means that several pieces out of each production run will be unsuitable for their intended use. The errors arise due to the motion of the wire in different axes from the axis of movement of the wire, i.e., flexing of the wire during movement. To prevent this movement, many of the prior art devices "thread" the wire through a guide hole adjacent the bend head. Of course, while the bend head guide hole will substantially eliminate the flexing of the wire, it also adds a removal step to the bending process, which decreases the rate at which wires will be produced and renders the device less efficient. There is therefore a need for a wire bending device that holds the wire in a stationary position during the bending process while the bending head travels along the wire.

Another problem encountered in the prior art is that the majority of bending devices support the wire above the bending unit, which forces the operator of the device to remove the wire from the machine after bending instead of the wire being released to fall into a stocking bin or the like. Again, the inefficiencies inherent in this design are obvious and there is a need for a solution to this design flaw.

Therefore, an object of the present invention is to provide an improved wire bending device.

Another object of the present invention is to provide a wire bending device which will automatically feed wires to be bent into the bending section of the device.

Another object of the present invention is to provide a wire bending device which includes a bending head and a wire securement device that rotates the wire to permit three-dimensional bending of the wire.

Another object of the present invention is to provide a wire bending device that is at least partially computer-controlled to enable rapid resetting of bend positions in the wire and to allow for multiple bend patterns to be accessed and used without requiring resetting of the bend information.

Another object of the present invention is to provide a wire bending device which includes a wire securement device such as an air bladder actuated chuck that will hold a very short section of the end of the wire to permit substantially the entire wire to be bent.

Finally, an object of the present invention is to provide a wire bending device which is relatively simple and sturdy in construction and is safe and efficient in use.

SUMMARY OF THE INVENTION

The present invention provides a wire bending device which includes an upright frame and a wire feed hopper for dispensing wire rods, the hopper mounted on the frame. A wire bending section is mounted on the frame, and at least one transport arm is pivotally mounted on the frame, the transport arm including a releasable wire holding device such as a magnet mounted thereon for releasably holding a wire rod, the transport arm being operative to transport wire rods from the hopper to the wire bending section of the device. The wire bending section includes a rotatable wire securement device mounted on the frame and having a center longitudinal axis, the rotatable wire securement device operative to secure one end of a wire rod and rotate the wire rod about its longitudinal central axis and a wire bending unit movably mounted on the frame, the wire bending unit including a wire bend head aligned with the center longitudinal axis of the rotatable wire securement device, the wire bending unit adapted to move on the frame such that the wire bend head remains aligned with the center longitudinal axis of the rotatable wire securement device. A control unit such as a programmable computer is operatively connected to the transport arm, the rotatable wire securement device and the wire bending unit, the control unit programmed to engage the transport arm to transport a wire rod from the hopper to the wire bending section, engage the rotatable wire securement device to secure one end of the wire rod, move the wire bend head to determined bend locations on the wire rod and rotate the wire rod about its longitudinal central axis to programmed positions, and engage the wire bend head to perform the programmed bend in the wire rod.

The present invention thus provides a substantial improvement over those bending devices found in the prior art. For example, many devices require manual insertion of wires to be bent into the device, whereas the present invention automatically feeds wires into the bending section. Furthermore, because the present invention provides for rotation of the wire rod, three-dimensional bends may be formed in the wire. Also, the precise controllable positioning of the wire bend head greatly reduces the chances of unusable wires being produced. Repeatability and consistency are the hallmarks of the present invention, and thus it is seen that the present invention is superior to those devices found in the prior art.

DESCRIPTION OF THE PREFERRED EMBODIMENT

Figure 1:
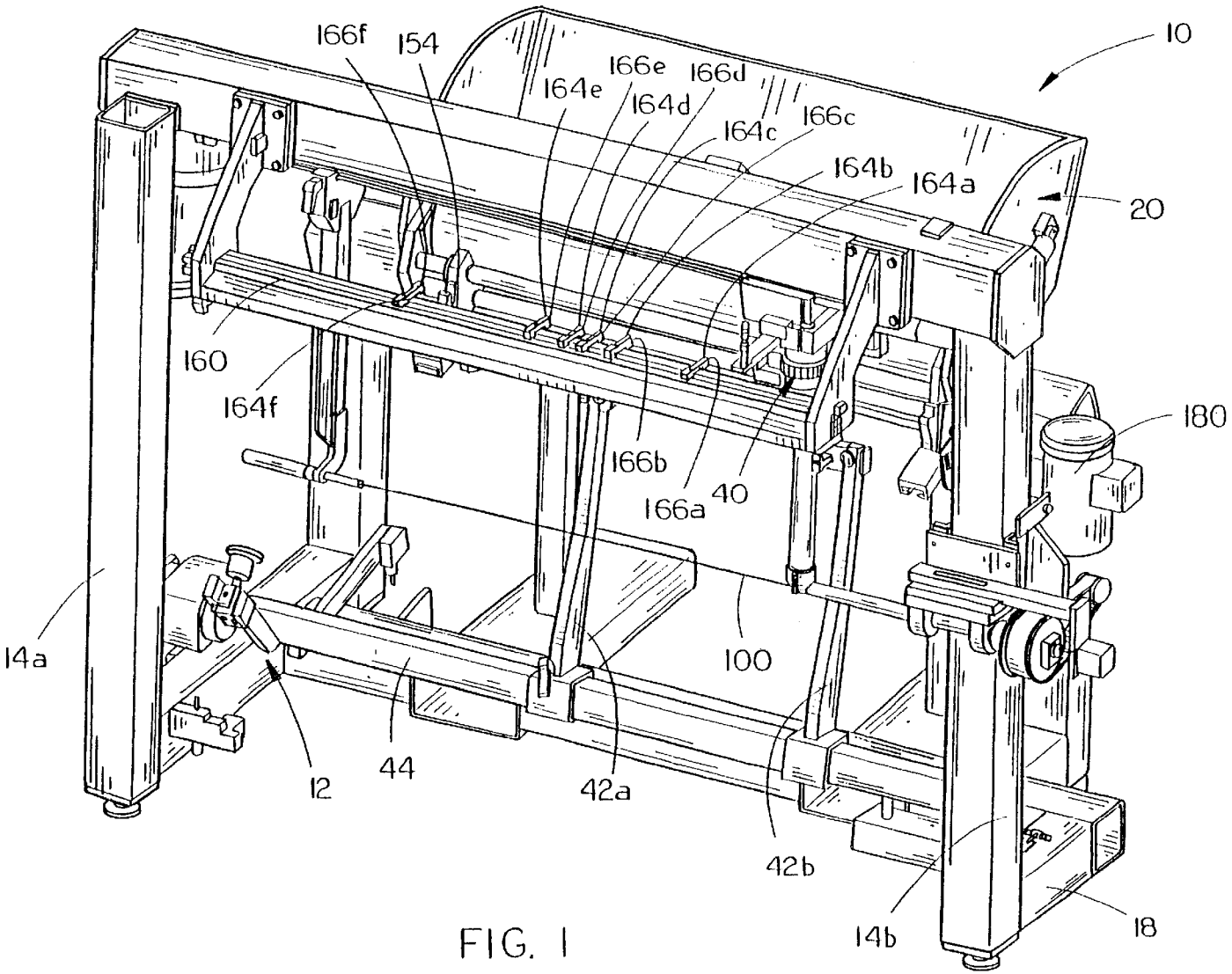
FIG. 1 is a perspective view of the wire bending apparatus of the present invention.
Figure 2:
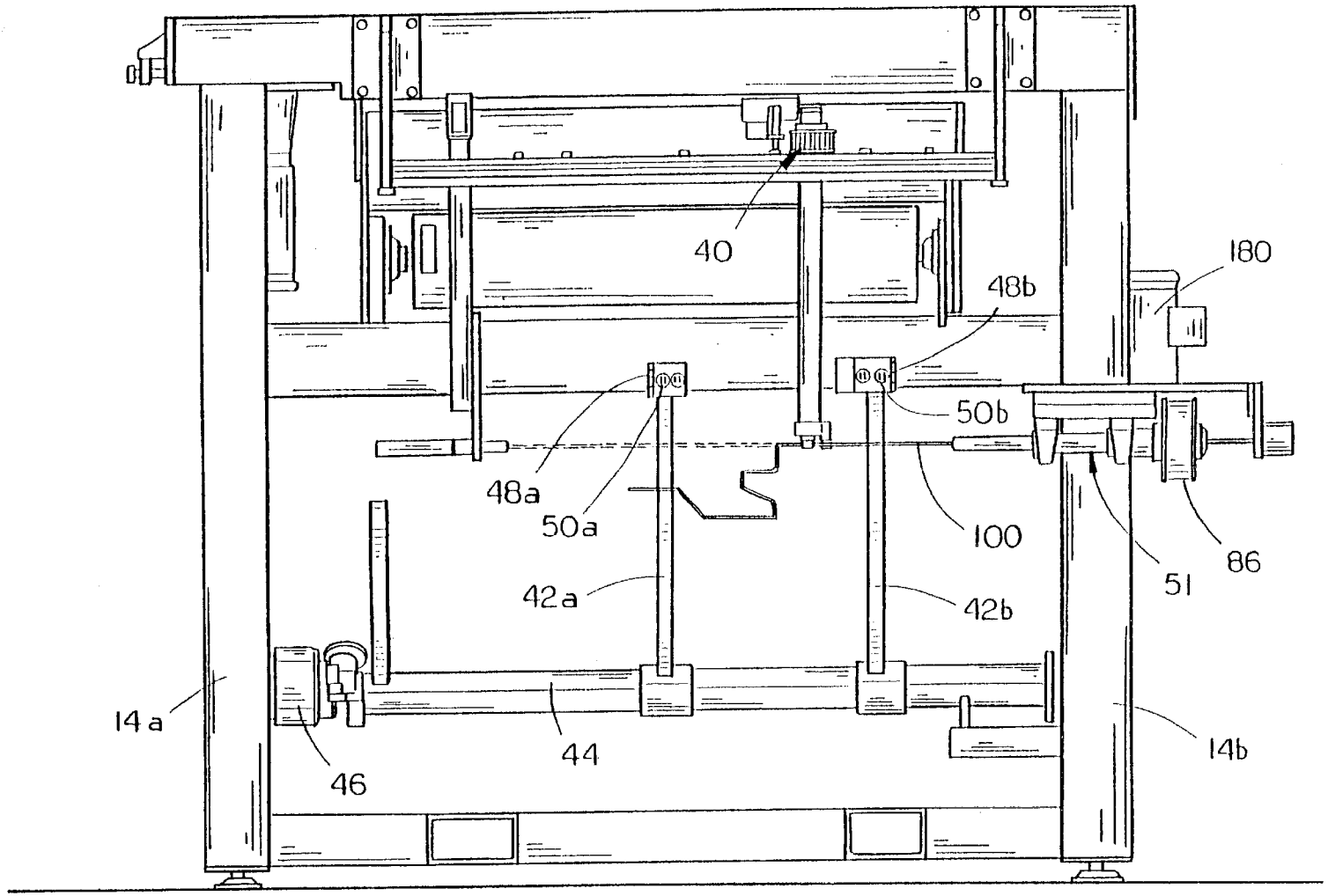
FIG. 2 is a front elevational view of the present invention.

The wire bending device 10 of the present invention is best shown in FIGS. 1–5 as including an upright frame 12 having vertical support beams 14*a* and 14*b* and upper horizontal support beam 16 extending between and connecting vertical support beams 14*a* and 14*b*. The base structure 18 of upright frame 12 which is shown in FIGS. 1 and 2 may be constructed in various other manners so long as the support functions of the base structure 18 are fulfilled.

For clarity and to provide a better understanding of the operation of the present invention, the description of the present invention will follow the progress of a single wire rod 100 as it is fed through the wire bending device 10 of the present invention. Therefore, the present description begins with the wire rod 100 being positioned within the hopper 20, which is shown best in FIGS. 1–5. The hopper 20, in the preferred embodiment, would include a large wire holding bin 22 having a width of approximately forty-eight inches. Of course, the precise width of the bin 22 is not critical to the present invention, so long as wire rods which are to be bent by the wire bending device 10 are of smaller length than the width of wire holding bin 22 to fit therewithin. The wire rods stored within bin 22 would be stacked atop one another and aligned generally parallel with each other within the wire holding bin 22, the wire rods being removed from wire bin 22 by feed mechanism 24 positioned adjacent the lower front of wire holding bin 22, as shown best in FIG. 5. In the preferred embodiment, the feed mechanism 24 would include a large cylindrical roller 26 mounted within wire holding bin 22 and adjustably spaced from base 28 of wire holding bin 22 such that the gap between the outer wall of roller 26 and base wall 28 may be adjusted. It is preferred that the forward end of base wall 28 be lower than the rear end of base wall 28 such that wire rods within wire holding bin 22 will roll forward to contact the outer wall of roller 26 as the outer wall of cylindrical roller 26 at base wall 28 approach one another. It is further preferred the cylindrical roller 26 be mounted on wire holding bin 22 in connection with a biasing device 30 such as a spring tension device. Biasing device 30 would act to force cylindrical roller 26 downwards towards base wall 28 thus, preventing the unintentional exit of wire rods from between cylindrical roller 26 and base wall 28. When cylindrical roller 26 is rotated in a clockwise direction, the lowermost wire rod 100 is engaged by the outer wall 27 of cylindrical roller 26 and pulled forward due to frictional contact therewith. Because the diameter of wire rod 100 is greater than the cap between cylindrical roller 26 and base wall 28, cylindrical roller 26 moves upwards slightly, but continues to be biased downwards due to the effect of biasing device 30 on cylindrical roller 26. In this manner, the feeding of wire rods may be precisely controlled through the rotation of cylindrical roller 26 specifically for the purpose of aligning the rods in a single layer.

Figure 5:
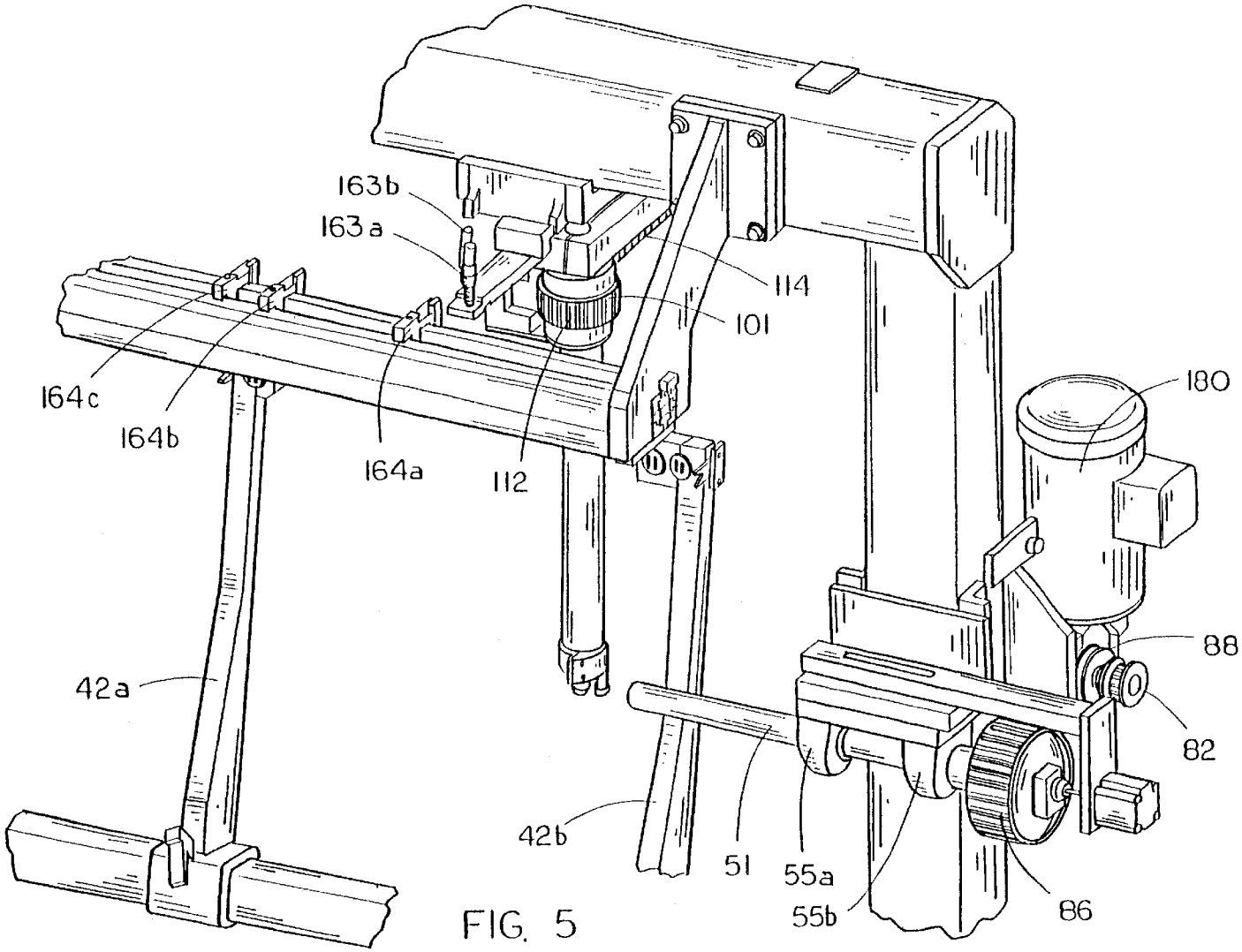
FIG. 5 is a partial perspective view of the invention.
Figure 6:
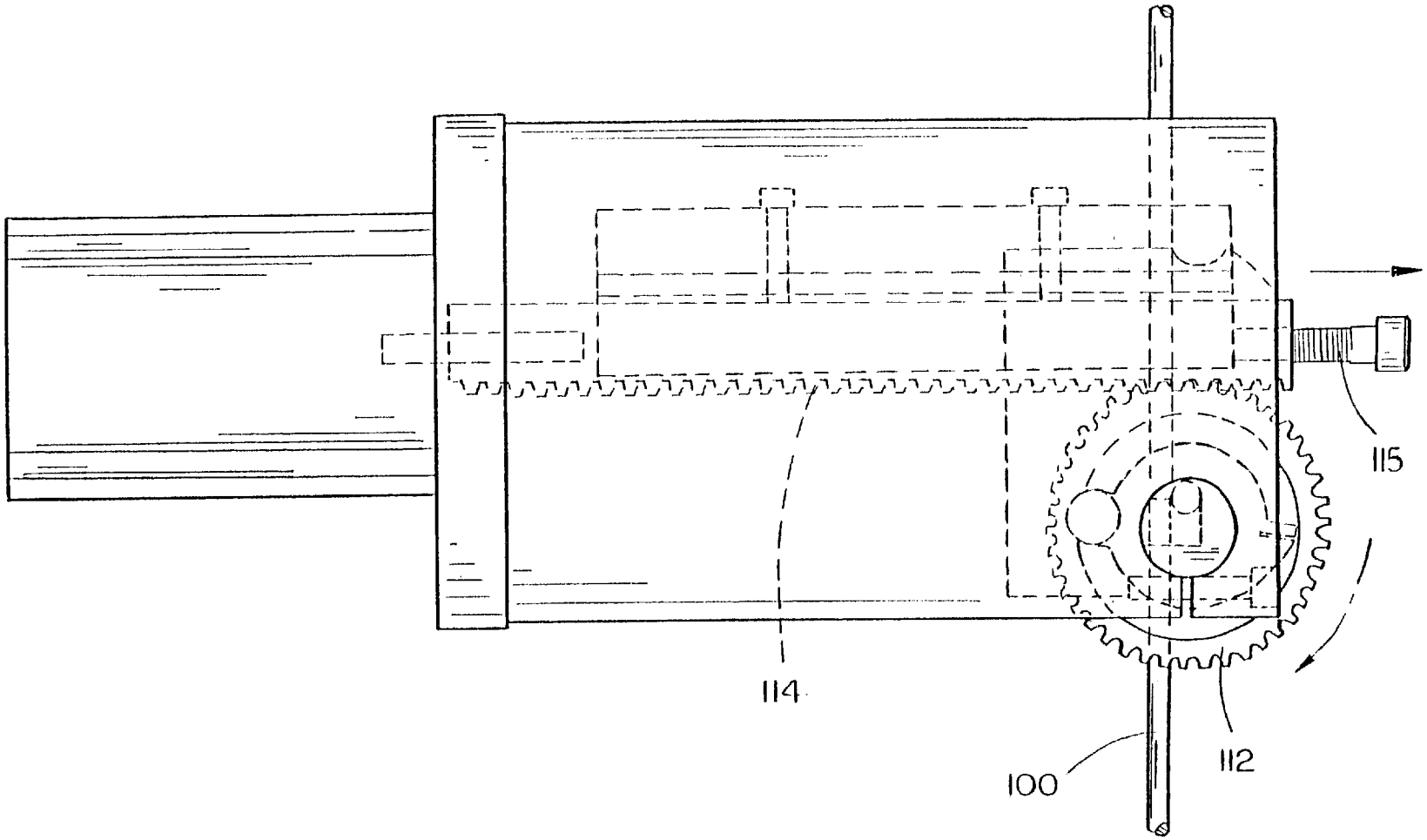
FIG. 6 is a partial top elevational view of a portion of the wire bending apparatus.
Figure 7:
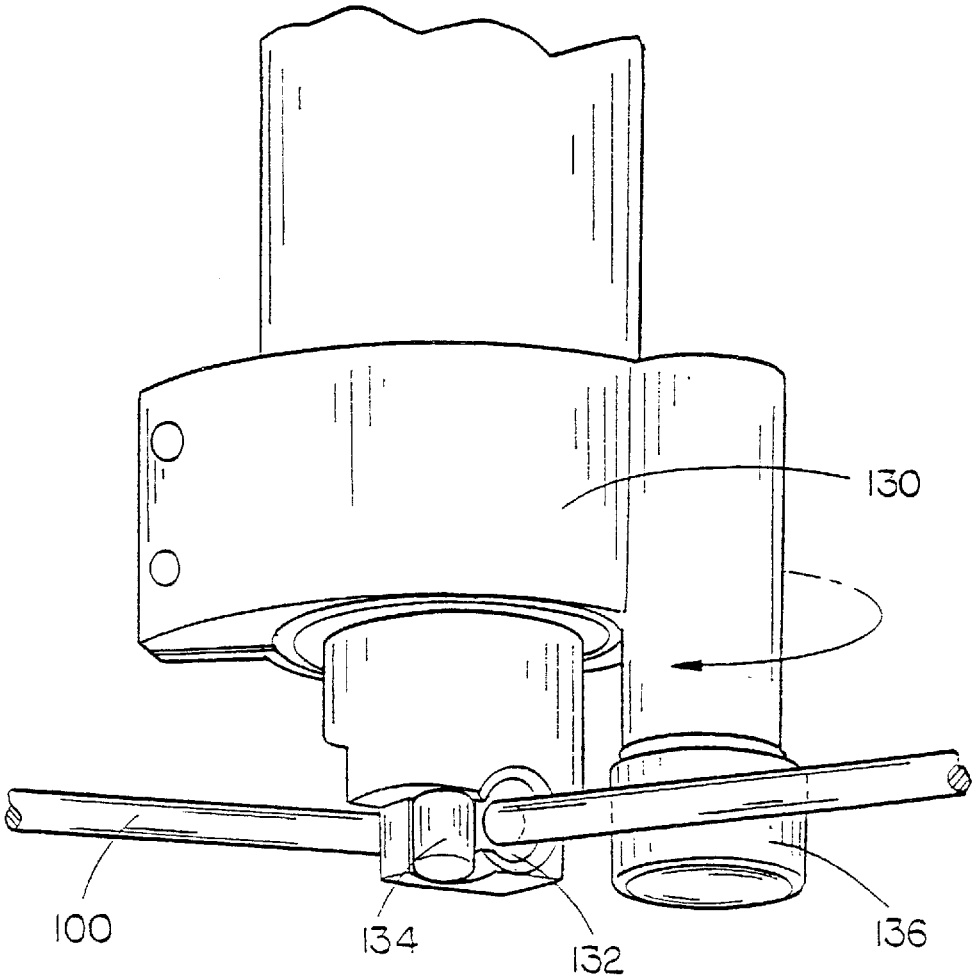
FIG. 7 is a partial perspective view illustrating the wire rod having been bent 90°.
Figure 8:
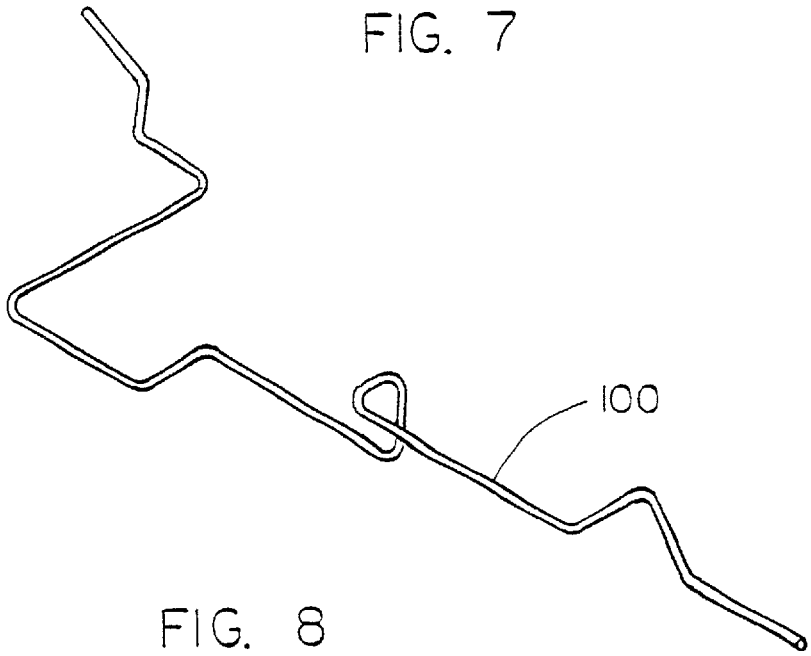
FIG. 8 is a perspective view of a wire rod having been bent several times.
Figure 9:
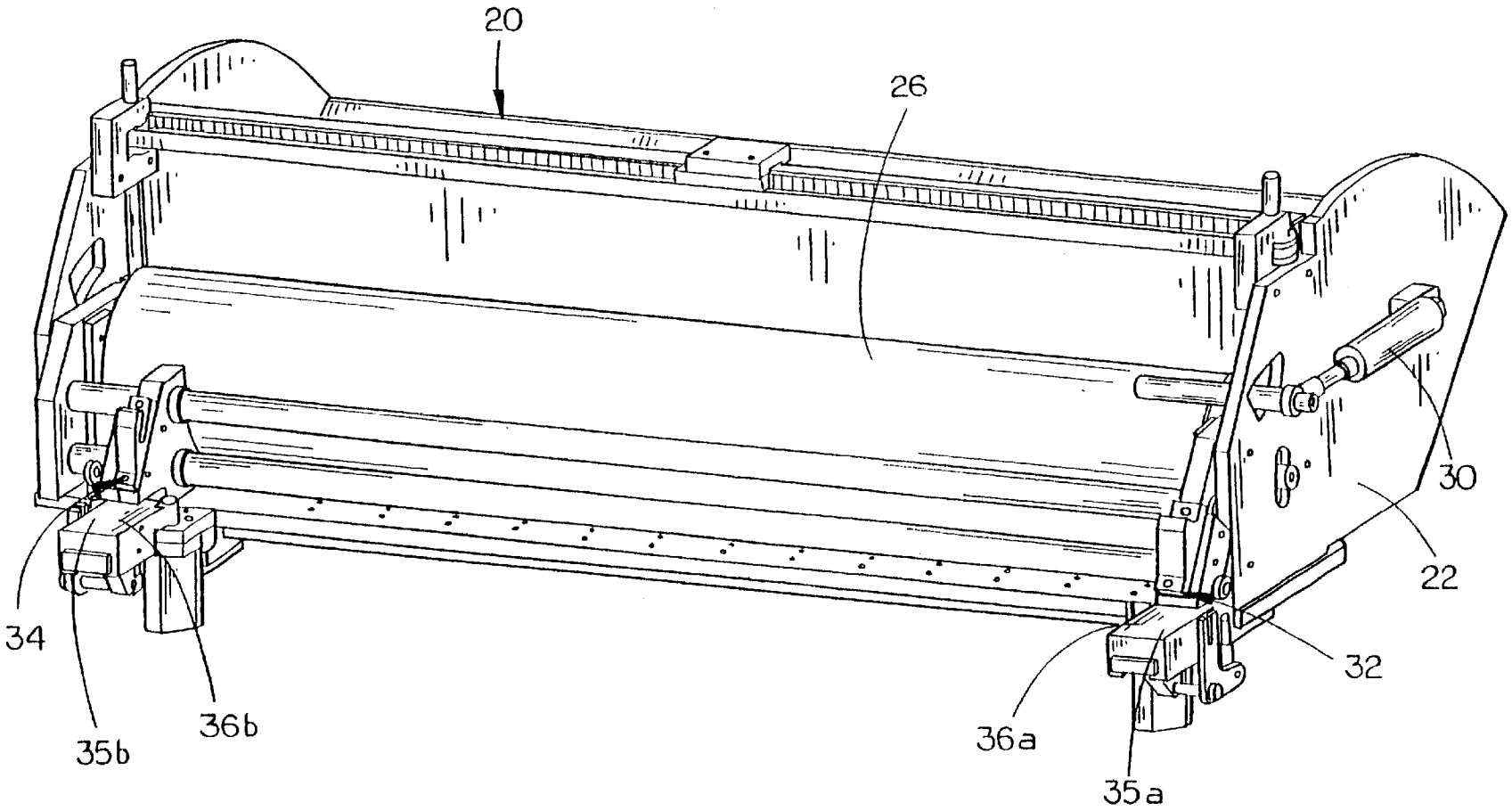
FIG. 9 is a perspective view illustrating the bin for storing the rods prior to their being bent.
Figure 10:
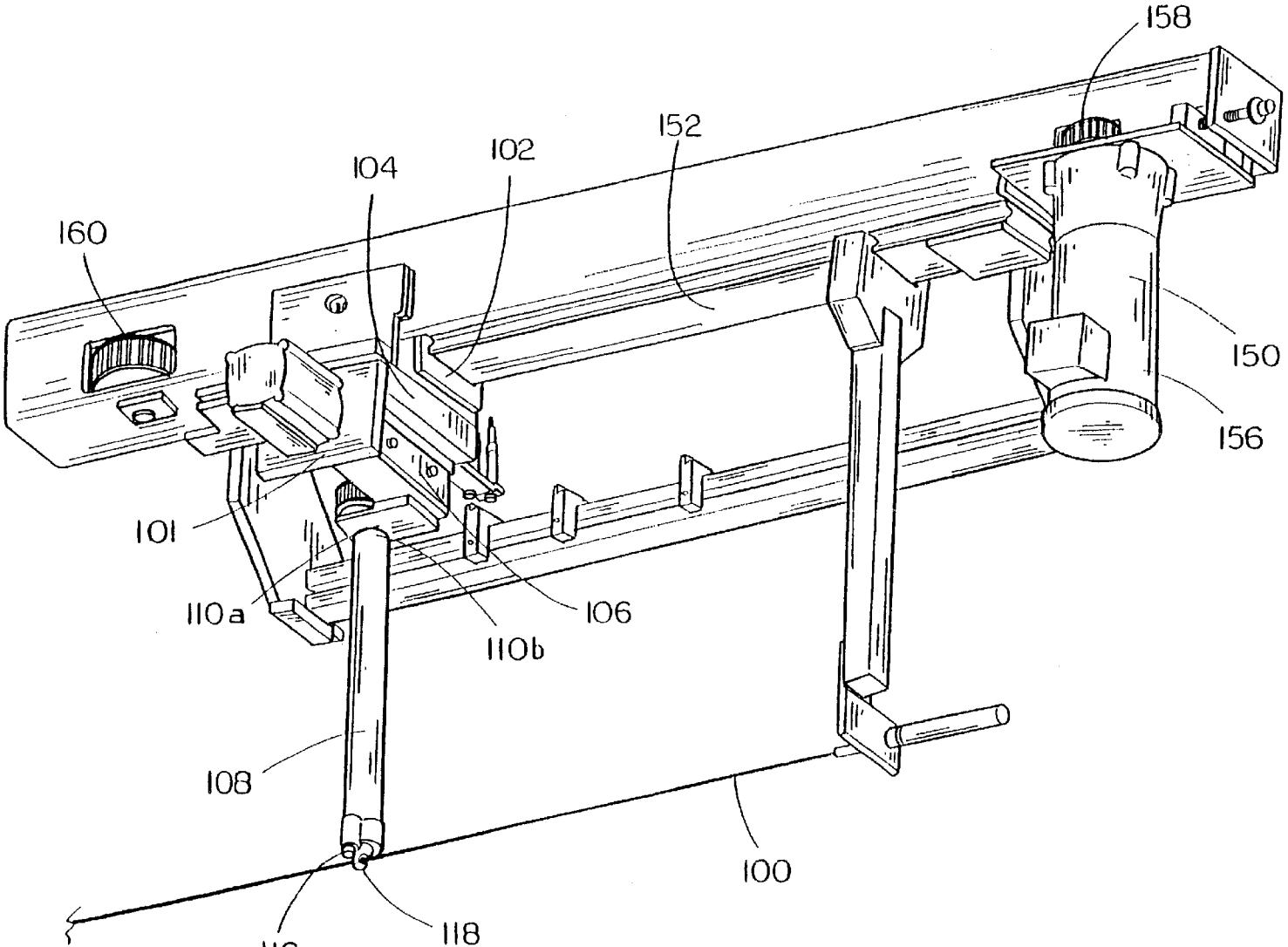
FIG. 10 is a partial bottom perspective view of portions of the invention.
Figure 11:
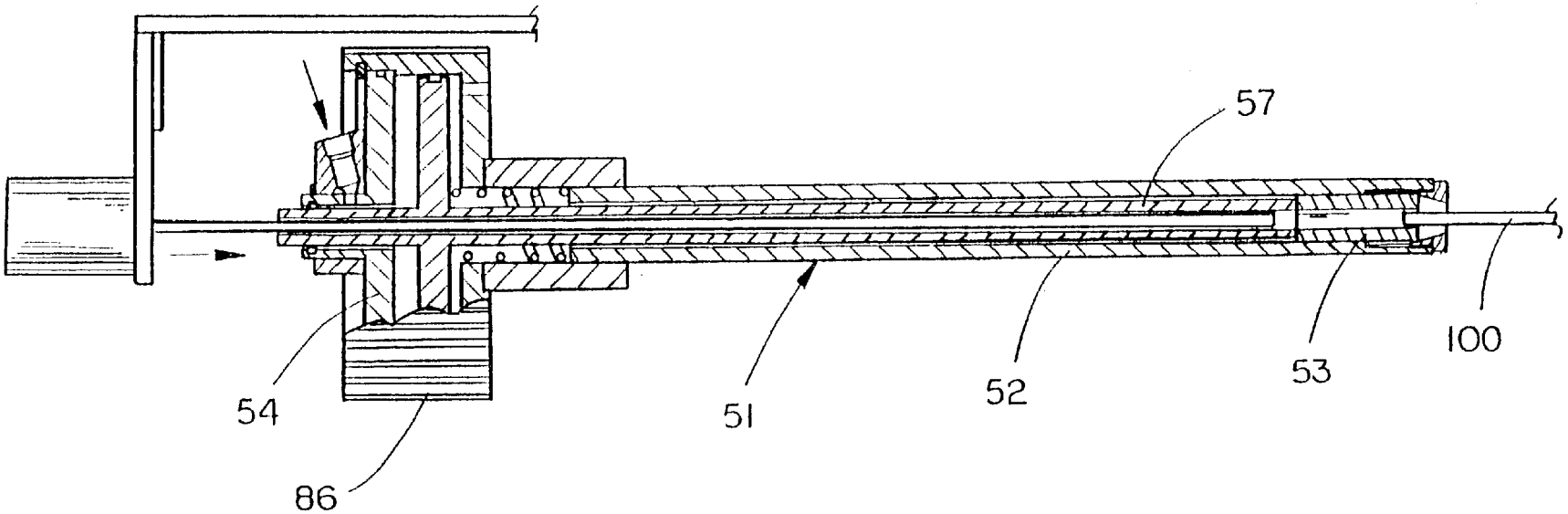
FIG. 11 is a partial sectional view of the wire feeding apparatus.
Figure 12A:
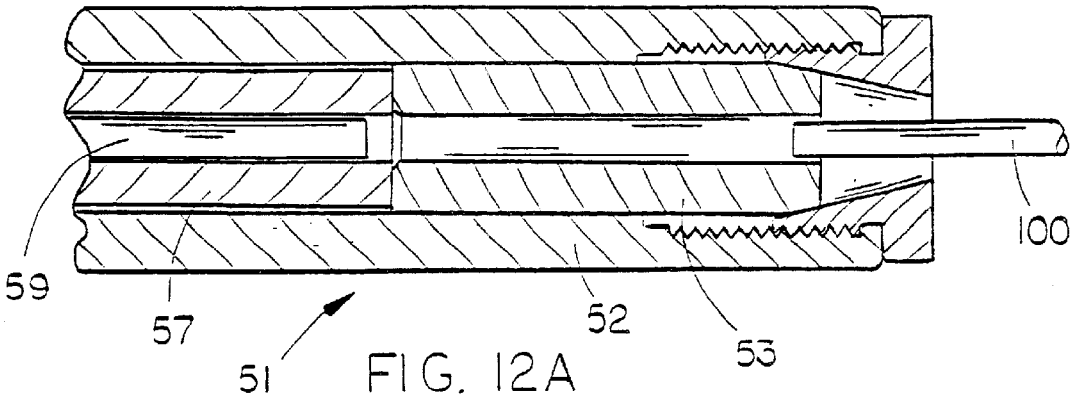
FIGS. 12A, 12B and 12C are sectional views illustrating the sequential movement of a rod through the wire rod feeding apparatus.
Figure 12B:
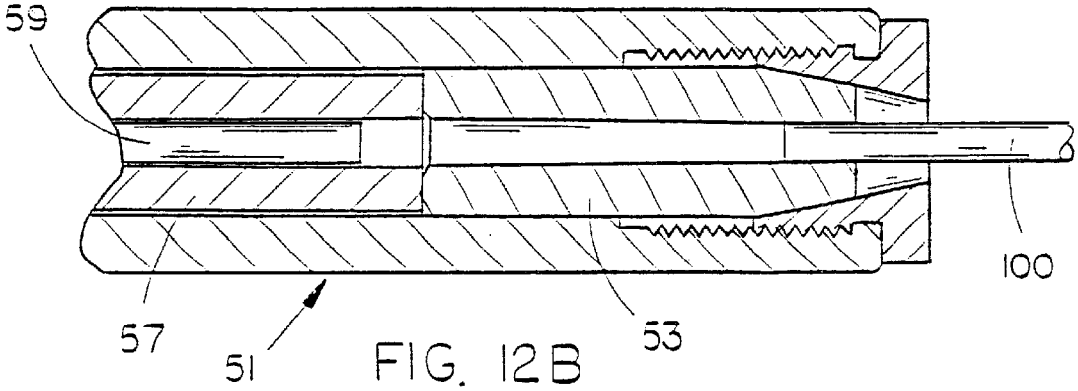
Figure 12C:
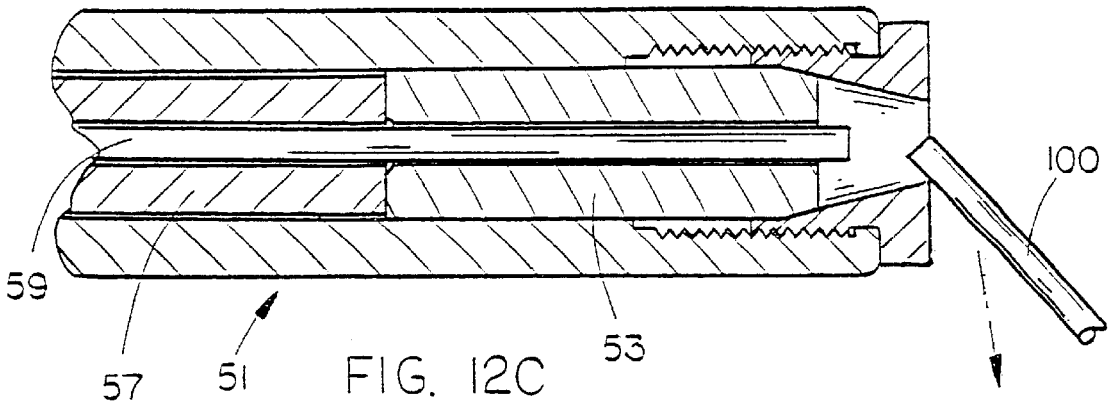
Figure 13:
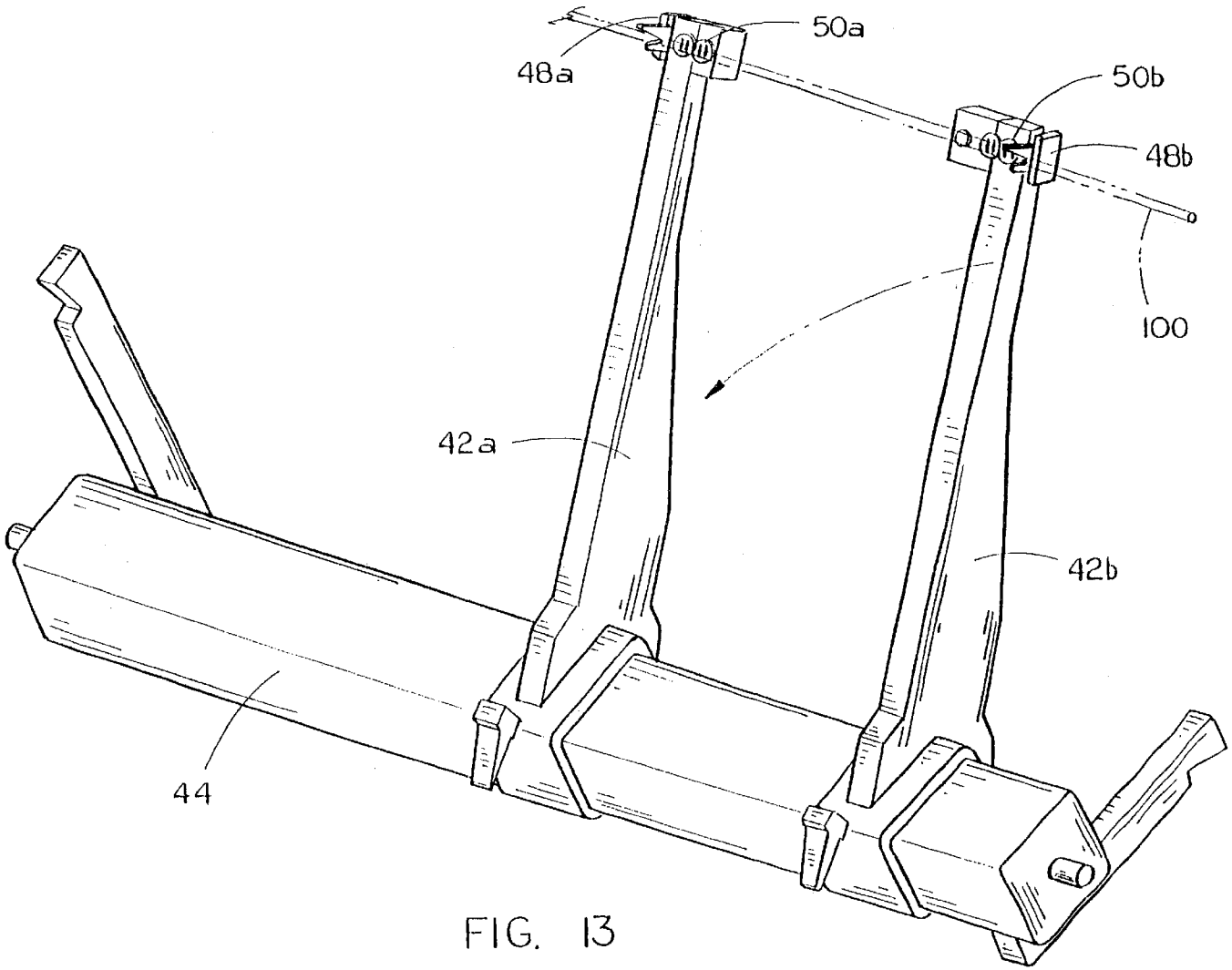
FIG. 13 is a perspective view of a portion of the invention.
Figure 14:
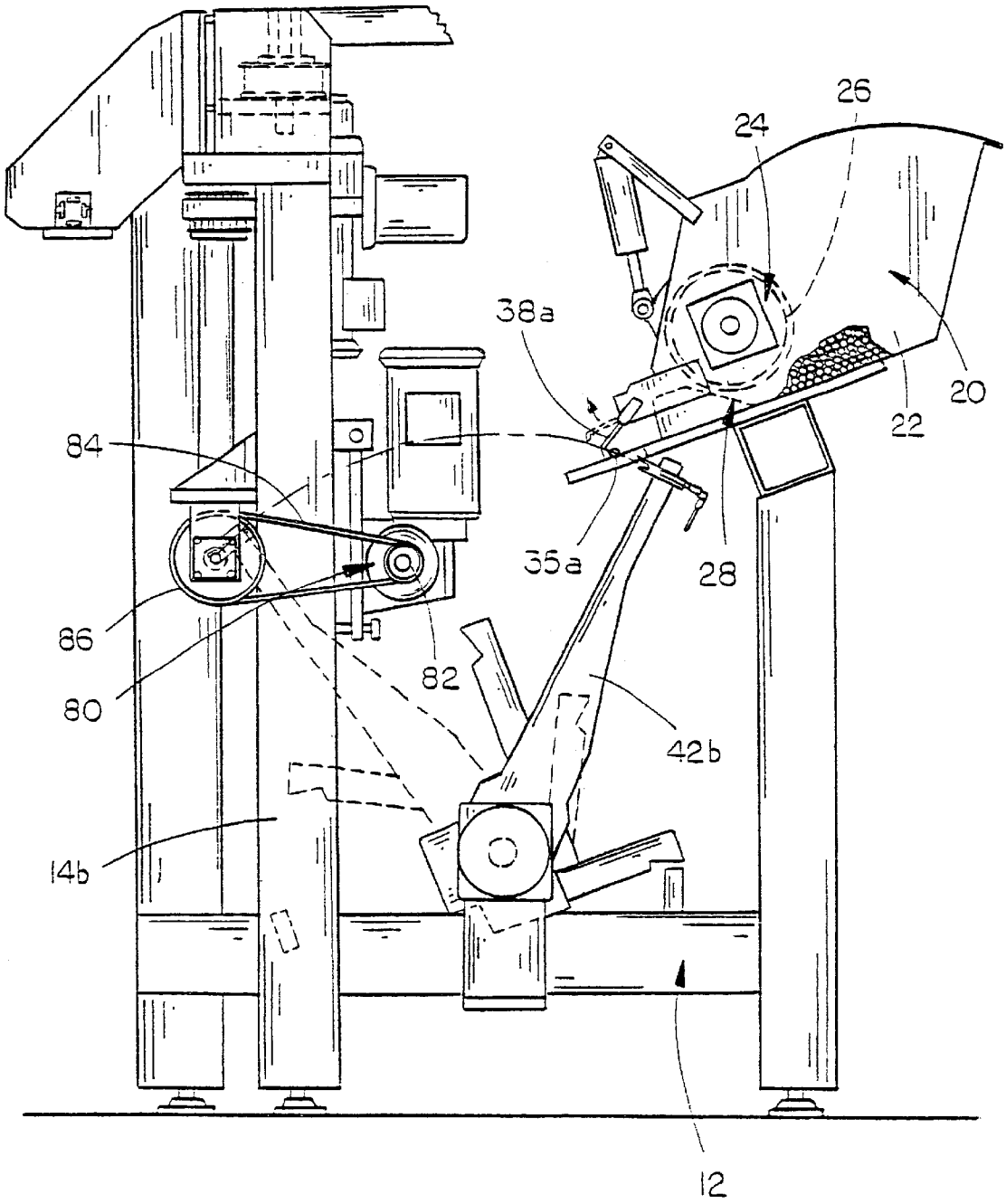
FIG. 14 is a partial end view of the invention.

When wire rod 100 moves forward far enough to disengage from cylindrical roller 26, wire rod 100 rolls forward down the slope of base wall 28 to contact the second section of the feed mechanism 24, shown best in FIG. 5. The second section of feed mechanism 24 includes right and left rod-receiving mechanisms 32 and 34, right rod-receiving mechanism 32 being mounted in a fixed position adjacent the forward end of base wall 28 and left rod-receiving mechanism 34 being adjustably mounted on a pair of slide bars 36*a* and 36*b* which will permit the distance between right and left rodreceiving mechanisms 32 and 34 to be adjusted. In this manner, different lengths of wire rods may be received and positioned correctly prior to being fed through the wire bending section of the present invention. In the preferred embodiment, when a wire rod 100 rolls into contact with left and right rod-receiving mechanisms 32 and 34, wire rod lifters 35*a* and 35*b* lift the wire rod 100 upwards above wall plates 36*a* and 36*b*, and the wire rod 100 then rolls forward on top of wall plates 36*a* and 36*b* until it is stopped by a pair of wire retention arms 38*a* and 38*b* which are pivotally mounted on the left and right rod-receiving mechanisms 32 and 34 whereby the wire rod 100 is supported in a feed-engaging position, as best shown in FIG. 6. The wire rod 100 is thus ready for transport from the hopper 20 to the wire bending section 40 of the present invention.

To move the wire rod 100 from the hopper 20 to the wire bending section 40 of the wire bending device 10 of the present invention, a pair of pivoting wire feed arms 42*a* and 42*b* are mounted on a rotating beam 44 mounted on base structure 18 of upright beam 12. The rotation of rotating beam 44 is controlled by an electric motor 46 mounted on upright frame 12, as shown best in FIGS. 1 and 2, whereby wire feed arms 42*a* and 42*b* may be rotated between a wire pick-up position adjacent hopper 20 and a wire feed position adjacent wire bending section 40 of wire bending device 10. In the preferred embodiment, leftmost wire feed arm 42*b* would be slidably adjustably mounted on rotating beam 44 to permit adjustment of positioning of wire feed arm 42*b* to accommodate variously sized wire rods. Mounted on the upper ends of each wire feed arm 42*a* and 42*b* are proximity switches 48*a* and 48*b* and electromagnets 50*a* and 50*b*, shown best in FIG. 2. As the wire feed arms 42*a* and 42*b* are pivoted into wire receiving position adjacent hopper 20, the proximity switches 48*a* and 48*b* signal that the arms 42*a* and 42*b* are in the correct position and stop the functioning of electric motor 46 thereby ceasing rotation of rotating beam 44. When the wire rod 100 is positioned within left and right rod-receiving mechanisms 34 and 32, the wire rod 100 is supported generally adjacent electromagnets 50*a* and 50*b* on the ends of wire feed arms 42*a* and 42*b*. Current then flows through electromagnets 50*a* and 50*b* thus releasably securing wire rod 100 to the wire feed arms 42*a* and 42*b*. At that same time, right and left rod-receiving mechanisms 32 and 34 release wire rod 100 by wire retention arms 38*a* and 38*b* pivoting upwards to permit the wire rod 100 to be transported to the wire bending section 40 of the present invention. Once the wire rod is released by rod-receiving mechanisms 32 and 34, electric motor 46 is engaged thus rotating the rotating beam 44 in a counterclockwise direction and pivoting wire feed arms 42*a* and 42*b* towards the wire bending section 40 of the present invention. Proximity switches 48*a* and 48*b* recognize the location of the wire bending section 40 and signal the electric motor 46 to stop rotating the rotating beam 44 when the wire rod 100 is aligned with the wire bending section 40 of the present invention. When rotation of rotating beam 44 ceases, the wire rod 100 is correctly positioned for securement within wire bending section 40 of the present invention.

The wire bending section 40 of the present invention is shown best in FIGS. 1–6 as including a wire securement mechanism 51 which receives the wire rod 100 held by electromagnets 50*a* and 50*b* on wire feed arms 42*a* and 42*b* and secures the wire rod 100 in a generally horizontal position below upper horizontal support beam 16 of upright frame 12. The wire securement mechanism 51, in the preferred embodiment, includes a wire support sleeve 52 into which the wire to be bent is inserted, the wire support sleeve 52 extending coaxially with the axis of rotation of the wire rotational mechanism 80. The sleeve 52 accepts the wire therein with the end of the wire seated only approximately one-eighth of an inch (⅛") within the outer end of the sleeve 52, and the wire is held within the sleeve 52 by a chuck 53 positioned within the sleeve 52. The chuck is opened and closed by the inflation and deflation of air bladder 54 which moves a shaft 57 within sleeve 52 which in turn expands or contracts the chuck to secure the wire therewithin. Of course, various kinds of chucks may be used with the present invention, each of which would be understood by one skilled in the art, but it is important that any chuck used in the invention be capable of securing the wire rod 100 using as short a section of the rod as practicable. Because of the chuck, wires may be quickly and easily inserted and removed from the sleeve 52 by inflating and deflating the air bladder 54.

Rotation of the wire is accomplished by the wire rotational mechanism 80 which, in the preferred embodiment, is a small wheel 82 connected by a belt 84 to the large wheel 86 concentrically mounted on the wire securement mechanism 50. Wire securement mechanism 51 is rotatably mounted on vertical support beam 14*a* by bearings 55*a* and 55*b* such that wire securement mechanism 51 can be rotated about the longitudinal axis of the wire being secured therein, the rotation being done by the driving of small wheel 82 by means of a precision drive motor 88 or the like, thus turning belt 84 and large wheel 86. The wire securement mechanism is thus rotated to align the wire in the next bending position. It is expected that the precision drive motor will be operatively connected to a computer to accurately control the amount of rotation of the wire to ensure precise bending of the wire, along with efficient repeatability of the programmed bending sequence.

Figure 4A:
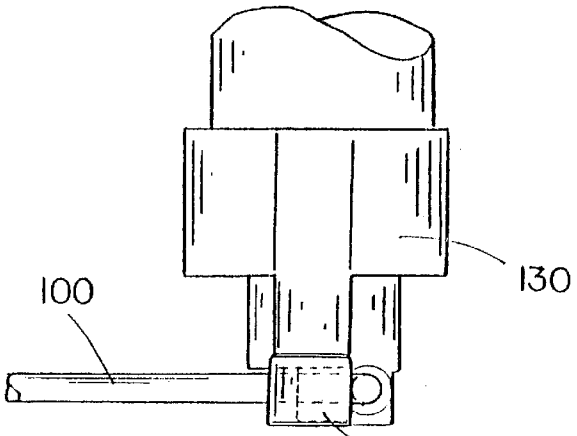
FIG. 4A is a view similar to FIG. 3 except that the rod has been bent 90°.
Figure 4B:
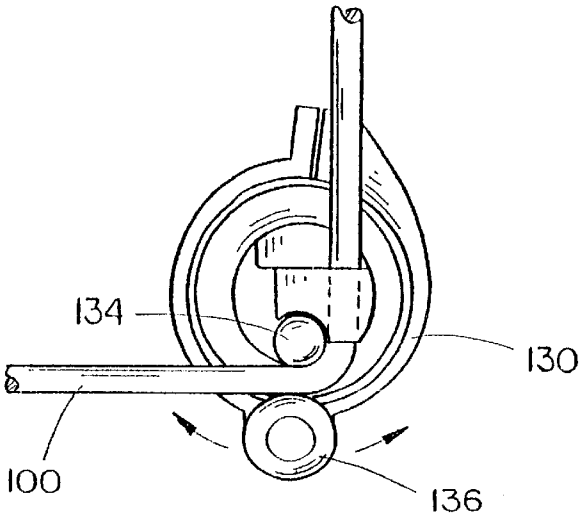
FIG. 4B is a bottom view of FIG. 4A.
Figure 3A:
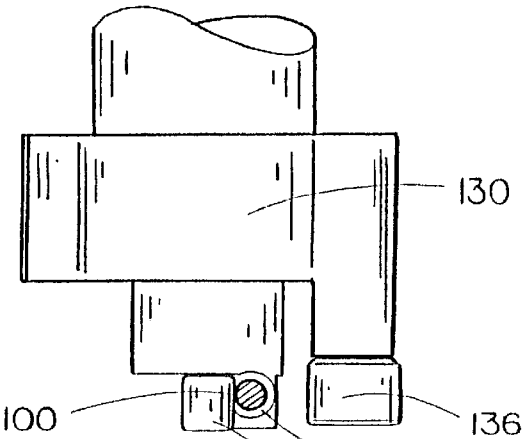
FIG. 3A is a partial end view illustrating the wire rod being positioned prior to bending.
Figure 3B:
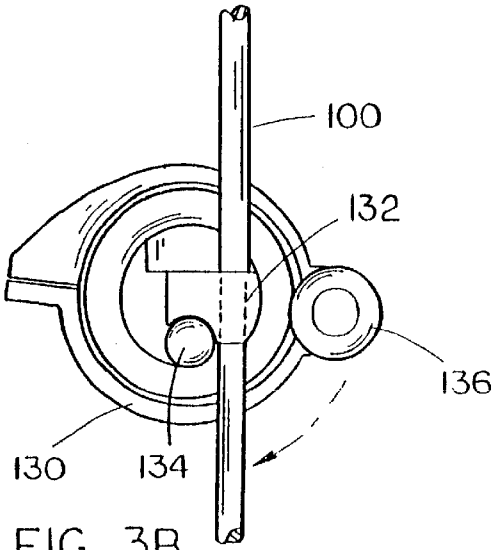
FIG. 3B is a bottom view of FIG. 3A.

The bending unit 101 is best shown in FIGS. 1 and 4 as including a base plate assembly having a generally inverted U-shaped slide plate 102 and a generally flat mounting plate 104 mounted on the slide plate 102. A cam support bar 106 extends generally perpendicular from the mounting plate 104, the cam support bar rotatably supporting a bending cam shaft 108 by bearing collars 110*a* and 110*b*. Mounted on the base of cam shaft 108 concentrically therewith is a cylindrical pinion 112 which rotates with cam shaft 108, pinion 112 intermeshing with movable rack 114. Movable rack 114 is driven perpendicular to the pinion 112 to rotate the pinion 112 and thus rotate the cam shaft 108. The rack 114 may be driven by any appropriate means, but it is preferred that the rack 114 be forced outwards by a pneumatic or hydraulic ram or the like. Mounted at the outward end of rack 114 is a projecting rack bolt 115 which extends outward to contact bend stop bolts, as will more clearly explained later in this disclosure.

The apparatus which actually bends the wire is referred to generally as the wire bend head and includes a cam follower 116 which is mounted on the side of the cam shaft 108 adjacent the top of the cam shaft 108 and a bend block 118 mounted on the cam support bar 106 adjacent the top of the cam support bar 106. The cam follower 116 rotates with the cam shaft 108 about bend block 118 to bend a wire extending therebetween about bend block 118, as the axis of rotation of the cam shaft 108 is generally aligned with the bend block 118, as shown in FIG. 4.

An alternative embodiment of the wire bend head is shown in FIG. 5 in which the cam shaft 108 is replaced by a cam sleeve 130 which rotates about an upright non-rotating bend head support shaft 132 extending upwards from mounting plate 104. On top of the support shaft 132 is the bend head 134 through which the wire to be bent extends. A cam follower 136 similar to the one described in connection with FIG. 4 is mounted on sleeve 130, and operates in a similar manner, i.e., rotating about the bend head 134 to bend the wire. One improvement permitted by this arrangement is that the bend head 134 may be quickly and easily switched to accommodate a new size of wire. The degree of bend of the wire is determined by the distance through which the rack 114 travels, thereby rotating the cam shaft 108 and thus cam follower 116. Also, the location of the bend made in the wire is determined by the location of the bending unit 101 along the wire. The positioning apparatus 150 for controlling the positioning of the bending unit 101 along the wire rod 100 is best shown in FIG. 2 as including a slide track 152 over which slide plate 102 fits, the slide track 152 permitting movement of the bending unit 101 parallel to the wire to be bent. There are two current best modes of moving the bending unit 101 along slide track 152, and these are by means of a rodless air cylinder 154 (shown in FIG. 1) or by means of an electric motor 156 mounted on the bending unit 101 which is connected to a gear 158 which intermeshes with a track 160 (shown in FIG. 2). Of course, it should be noted that any appropriate type of precisely controllable movement device may be substituted for those described above, such as a rack and pinion or mounting of the bending unit 101 on a movable rotating belt which extends along the table 12.

The two movement devices each operate in their understood manner, with the location of the bends in the wire being determined by the following system, which is shown best in FIGS. 3–6 in the preferred embodiment. Mounted on the forward portion of the mounting plate 104 are two proximity switches 163*a* and 163*b*, proximity switch 163*a* positioned slightly closer to said wire securement mechanism 51 than proximity switch 163*b* such that as said bending unit 101 moves towards the wire securement mechanism 51, proximity switch 163*a* encounters the stop/bend points before proximity switch 163*b*. A plurality of stop/bend collars 164*a*, 164*b*, 164*c*, 164*d*, 164*e* and 164*f* are adjustably mounted on a slide bar 168 mounted on the frame 12 forward of the slide track 160, as shown best in FIGS. 2 and 6. The horizontal position of each of the stop/bend collars 164*a–f* may thus be adjusted to signify bend points on the wire rod 100. As the bending unit 101 moves towards the wire securement mechanism 51, the speed of movement of the bending unit 101 is fast until proximity switch 163*a* signals the control unit 180 that the next stop/bend collar in line has been reached. The travel speed of the bending unit 101 is then immediately slowed and the bending unit moves at a reduced rate of speed until proximity switch 163*b* signifies that the bend location has been reached. Proximity switch 163*b* is positioned on the bending unit 101 such that the proximity switch 163*b* is aligned with the stop/bend collar when the bending unit 101 is in the precise location for the bend to be performed, thus permitting the bend to be formed in the wire rod 100 at the exact location determined by the operator.

Each of the stop/bend collars 164*a–f* include an inwardly extending, length-adjustable bend stop bolt 166*a–f* that extends inwards towards slide track 160, the bend stop bolts 166*a–f* positioned to impede the outward motion of rack 114 by receiving contact from the projecting rack bolt 115. The distance through which the rack 114 travels is determined by the bend stop bolts 166*a–f*. When the rack 114 is moved towards slide bar 168, thereby rotating the cam shaft 108, the movement of the rack 114 is stopped when projecting rack bolt 115 butts against the adjacent bend stop bolt 166*a–f*. The direction of rack movement then reverses and the bending unit is readied for the next bend to be made. By adjusting the length of the bend stop bolts 166*a–f*, the point at which the projecting rack bolt 115 contacts each bolt is changed, and thus the length of travel of the rack 114 is modified. If the rack 114 moves a greater distance, the degree of bend formed in the wire being bent is greater, and vice versa. Therefore, when the movable rack 114 is forced to move, pinion 112 and cam shaft 108 rotate thereby rotating cam follower 116 about bend block 118 thus forming a bend in the wire rod 100 extending from wire securement mechanism 50. Once the rack 114 has returned to its starting location, the control unit 180 senses this and engages the rodless air cylinder 154 or electric motor 156 to move the bending unit 101 to the next stop/bend collar 164*a–f*. Once all of the stop/bend collars 164*a–f* for the particular bend pattern have been encountered by the bending unit 101, the now bent wire rod 100 is released from the wire securement device 51 and the process begins anew.

The control unit 180 of the present invention is preferably a programmed computer which performs the functions coordinating the functioning of the invention. Specifically, the control unit 180 would initiate cylindrical roller 26 to feed a wire rod 100 to right and left rod-receiving mechanisms 32 and 34 which position wire rod 100 for transfer to the wire bending section 40. Electric motor 46 would then be engaged thus rotating the rotating beam 44 in a counterclockwise direction and pivoting wire feed arms 42*a* and 42*b* towards the wire bending section 40 of the present invention. Proximity switches 48*a* and 48*b* recognize the location of the wire bending section 40 and signal the electric motor 46 to stop rotating the rotating beam 44 when the wire rod 100 is aligned with the wire bending section 40 of the present invention. When rotation of rotating beam 44 ceases, the wire rod 100 is correctly positioned for securement within wire bending section 40 of the present invention.

The control unit 180 then signals wire securement device 51 to secure the wire rod 100 in wire bending position and engages the wire bending unit 101 to commence bending. As each positioned stop/bend collar 164*a–f* is reached, the proximity switches 163*a* and 163*b* signal the control unit 180 of the location of the wire bending unit 101, and the control unit 180 stops the movement of the wire bending unit 101 at the correct location for the bend to be made. After the bend is made in the wire rod 100, the control unit engages the rodless air cylinder 154 or electric motor 156 to move the bending unit 101 to the next bend location. Simultaneously, the control unit 180 rotates the wire rod 100 through engagement of the wire rotational mechanism 80 to the programmed alignment for the next bend in the bending sequence. Finally, when all of the bends of the wire rod 100 have been performed, the control unit signals the wire securement device 51 to release the wire rod 100 and the next wire rod is moved into position for bending.

The other primary function of the control unit 180 is to count the number of wires produced during the production run and to deactivate the wire bending device 10 upon reaching the preset production run number. This feature helps to lessen the tasks of the operator and permit the operator to be more efficient in production.

When taken as a whole, it is seen that a limitless number of types of bends in wires may be made by the present invention. By adding or subtracting stop/bend collars 164*a–f* the number of bends made in the wire can be precisely set, and by programming the control unit 180 to initiate rotation of the wire by means of the wire rotational mechanism 80 after a bend is made, the precise shape of the wire being bent can be controlled.

It is to be understood that numerous modifications, additions and substitutions may be made to the wire bending device 10 of the present invention which fall within the intended broad scope of the disclosure of this invention. For example, the size, shape and arrangement of the features of the present invention may be modified and changed so long as the functionality of the invention is maintained. Furthermore, the drive mechanisms for the various elements of the present invention may be replaced with other mechanisms found in the art, so long as the precise location control features are maintained. Finally, although the present invention has been described as including a wire transport device including transport arms, it is entirely feasible that alternative constructions would perform the transport tasks equally as well.

There has thus been shown and described a wire bending device which accomplishes at least all of the stated objectives.

We claim:

1. A wire bending device, comprising:

an upright frame;

a wire feed hopper for dispensing wire rods mounted on said frame; said wire feed comprising a holding bin, having at least a base wall and opposite side walls, and a feed mechanism; said feed mechanism comprising a generally cylindrical roller, having an outer surface, that is rotatably adjustably mounted within said holding bin, adjacent said base wall, such that the distance between the outer surface of the roller and the base wall may be selectively adjusted; and wire bending means mounted on said frame; said wire bending means including:

a rotatable wire securement device mounted on said frame and having a center longitudinal axis, said rotatable wire securement device operative to secure one distal end of a wire rod and rotate the wire rod about its longitudinal central axis;

a wire bending unit movably mounted on said frame; and a wire bend head aligned with said center longitudinal axis of said rotatable wire securement device, said wire bending unit adapted to move on said frame such that said wire bend head remains aligned with said center longitudinal axis of said rotatable wire securement device.

2. The wire bending device of claim 1 wherein said feed mechanism is further comprised of a biasing mechanism operatively connected to said roller to force the roller toward said base wall and selectively permit wire rods to pass between said roller and said base wall.

3. The wire bending device of claim 2 wherein said feed mechanism is further comprised of at least one wire receiving mechanism, operatively and adjustably connected to said holding bin to hold and position wire rods that pass between said roller and said base wall.

4. A wire bending device, comprising:

an upright frame;

a wire feed hopper for dispensing wire rods mounted on said frame;

wire bending means mounted on said frame; and at least one transport arm pivotally mounted on said frame, said transport arm including releasable wire holding means mounted thereon for releasably holding a wire rod, said transport arm operative to transport wire rods from said hopper to said wire bending means;

said wire bending means including:

a rotatable wire securement device mounted on said frame and having a center longitudinal axis, said rotatable wire securement device operative to secure one distal end of a wire rod and rotate the wire rod about its longitudinal central axis;

a wire bending unit movably mounted on said frame; and a wire bend head aligned with said center longitudinal axis of said rotatable wire securement device, said wire bending unit adapted to move on said frame such that said wire bend head remains aligned with said center longitudinal axis of said rotatable wire securement device.

5. The wire bending device of claim 4 further comprising a control means operatively connected to said at least one transport arm, said rotatable wire securement device and said wire bending unit, said control means programmed to engage said at least one transport arm to transport a wire rod from said hopper to said wire bending means, engage said rotatable wire securement device to secure one end of the wire rod, move said wire bending unit to designated locations on the wire rod, rotate the wire rod about its longitudinal central axis to programmed positions, and engage said wire bend head to perform the programmed bend in the wire rod.

* * * * *